US006688502B2

(12) United States Patent
Kunreuther

(10) Patent No.: US 6,688,502 B2
(45) Date of Patent: Feb. 10, 2004

(54) HANGER CONNECTOR

(76) Inventor: Steven Kunreuther, 285 Central Park West, New York, NY (US) 10024

( * ) Notice: Subject to any disclaimer, the term of this patent is extended or adjusted under 35 U.S.C. 154(b) by 0 days.

(21) Appl. No.: 10/193,946

(22) Filed: Jul. 15, 2002

(65) Prior Publication Data

US 2004/0007603 A1 Jan. 15, 2004

(51) Int. Cl.[7] ..... A41D 27/22
(52) U.S. Cl. ..... 223/85
(58) Field of Search ..... 403/82, 190, 352; 248/339; 223/85

(56) References Cited

U.S. PATENT DOCUMENTS 2,753,143 A * 7/1956 Berlt ..... 248/317
4,007,861 A 2/1977 Duester et al.
4,514,178 A 4/1985 Noto et al.

OTHER PUBLICATIONS

Sample of Mainetti Connector Marked: Reg. Des. 2094999
Sample of Connector marked 4007861.

* cited by examiner

*Primary Examiner*—John J. Calvert
*Assistant Examiner*—James G Smith
(74) *Attorney, Agent, or Firm*—Robert L. Epstein; Harold James; James & Franklin, LLP

(57) ABSTRACT

The connector connects a supported hanger and a supporting hanger. The connector engages the supported hanger at spaced points to avoid swaying of the supported hanger relative to the supporting hanger. The hangers are connected with their centers of gravity aligned so as to prevent tipping under the weight of the supported apparel. The connector is received on the supporting hanger so as not to obscure an indicia bearing clip mounted on the arcuate bar engaging part of the support hanger.

29 Claims, 5 Drawing Sheets

10
11
12
14
26a
26b
26c
28a
28b
28c
38
40
42
A

HANGER CONNECTOR

The present invention relates to hangers which support and display apparel and more particularly to a connector for two hangers which support and display related items of apparel for merchandising purposes.

Apparel manufacturers are always looking for ways to merchandise their products more effectively. One very successful merchandising method has been to coordinate related articles of apparel to provide the consumer with matched sets of apparel articles, such as skirts and pants that are designed to be worn together. In this way, the consumer may more easily select and purchase apparel articles that go together well in terms of style, color, pattern or the like.

In the market, this is currently done by using hangtags with matching indicia, for example, colors, as set forth in U.S. Pat. No. 4,514,178, issued Apr. 30, 1985, to Noto et al., owned by Garan, Inc., 350 Fifth Avenue, New York, N.Y. 10118. Other types of matching indicia, such as images of animals on hangtags, labels or on the articles themselves have also been utilized.

Another way to accomplish this is to package related articles of apparel together in a single package or to display the related articles on a set of connected hangers. The present invention relates to an inexpensive plastic connector designed to join hangers which carry related articles of apparel.

Although hanger connectors have been used previously, the present invention is superior to known hanger connectors in several ways. Hangers include an arcuate bar engaging part joined to the apparel supporting part by a neck part. Prior art hanger connectors engage the arcuate part of the supported hanger at only one point. Because the supported hanger is supported at only one point, it is free to sway relative to the supporting hanger.

Further, in prior hanger connectors, the point where the connector engages the supported hanger is on the centerline of the connector. However, the arcuate part of the supporting hanger is situated on the apparel supporting part at a point that is offset from the centerline of the supporting hanger. Thus, when the connector is received over the arcuate part of the supporting hanger, the centerline of the connector is offset from centerline of the supporting hanger. Because the connector supports the supported hanger at a point on the centerline of the connector, and the centerline of the connector is offset from the centerline of the supporting hanger, the weight of the article on the supported hanger tends to tip the supported hanger relative to the supporting hanger.

The connector of the present invention eliminates these problems by engaging the arcuate part of the supported hanger at spaced locations on the connector that are situated in a pattern that corresponds to the curve of the arcuate part of the supported hanger and by supporting the supported hanger in a position in which its centerline aligns with the centerline of the supported hanger. In this way, the connector holds the supported hanger more securely, without permitting movement of the supported hanger relative to the supporting hanger, and the centers of gravity of both hangers are situated along the same line so that hangers do not tip when supporting apparel.

In addition, the arcuate part of many hangers carry a removeable indicia bearing the clip that contains inventory control or other pertinent information. It is important that this information be visible and not obscured by the hanger connector. The connector of the present invention is designed to ensure that the information on the clip is not hidden when the connector is in place on the supporting hanger.

It is, therefore, a prime object of the present invention to provide a hanger connector that engages the supported hanger in a manner which eliminates swaying of one hanger relative to the other.

It is another object of the present invention to provide a hanger connector that engages the supported hanger at spaced points situated in an arcuate pattern to hold the supported hanger more securely.

It is another object of the present invention to provide a hanger connector that engages the supported hanger at a position offset from the centerline of the connector, such that the centerlines of the supported and supporting hangers align.

It is another object of the present invention to provide a hanger connector in which the connector does not obscure the indicia bearing clip mounted on the arcuate part of the supporting hanger.

In accordance with one aspect of the present invention, apparatus is provided for connecting a first hanger and a second hanger. Each of the hangers includes an arcuate part for engaging a bar and an apparel supporting part. The apparatus comprises a first body portion defining an opening adapted to receive the arcuate part of the first hanger. The apparatus also has a second body portion. First and second means for engaging the arcuate part of the second hanger are mounted on the second body portion in spaced relation.

The first and second engaging means are located on the second body portion in an arcuate pattern. The arcuate pattern corresponds to the shape of the arcuate part of the second hanger.

The first body portion is situated in a first plane. The second body portion is situated in a second plane. The first and second planes meet to form an obtuse angle.

Each of the engaging means on the second body portion includes an engaging part that defines a recess adapted to receive the arcuate part of the second hanger. Each engaging part includes first and second spaced side elements extending from the second body portion. The first and second side elements are preferably substantially parallel to each other. The first side element is preferably wider than the second side element. Each engaging part also includes an element bridging the first and the second side elements, one of which is wider than the other. The bridging element is tapered to accommodate the different widths of the side elements.

The engaging means are mounted at positions which form an arc with a center. The center of the arc is offset from the centerline of the second body portion by a given distance, in one direction. The arcuate part of the first hanger is joined to the apparel supporting part at a point that is offset from the centerline of the first hanger. The center of the arc is offset from the centerline of the second body portion by the given distance, in a direction opposite to the offset of the arcuate part. This compensates for the offset position of the arcuate part of the first hanger and results in the centerlines of the hangers, and hence the centers of gravity of the hangers, being in alignment.

The base of the arcuate part at the point where it joins the supporting part has a given width. The arcuate part receiving opening is at least as wide as the width of the base of the arcuate part.

In accordance with another aspect of the present invention, a first hanger, a second hanger and means for connecting the first hanger and second hanger are provided. Each of the hangers includes an arcuate part for engaging a bar and an apparel supporting part. The connecting means comprises a first body portion defining an opening adapted to receive the arcuate part of the first hanger and a second body portion. First and second spaced means for engaging the arcuate part of the second hanger are provided on the second body portion.

The first body portion is in a first plane. The second body portion is in a second plane. The first and second planes join to form an obtuse angle.

Each of the engaging means defines a recess adapted to receive the arcuate part of the second hanger. Each of the engaging means comprises first and second spaced side elements. The side elements extend from said second body portion. One of the side elements is wider than the other of the side elements.

Each of the engaging means further comprises an element bridging the first and second side elements. The bridging element is preferably tapered to accommodate the different widths of the side elements.

The first and second side elements are preferably substantially parallel to each other. The first and second engaging means are mounted on the second body portion in an arcuate pattern defining an arc with a center that is offset by a given distance, in a given direction, from the centerline of the second body portion. The arcuate part of the first hanger is joined to the apparel supporting part by a neck part at a point that is offset from the centerline of the first hanger by the given distance, in a direction opposite to the given direction.

The base of the arcuate part has a given width. The arcuate part receiving opening on the first body portion is at least as wide as the given width.

To these and to such other objects which may hereinafter appear, the present invention relates to a hanger connector as described in detail in the following specification and recited in the annexed claims, taken together with the accompanying drawings, in which like numerals refer to like parts, and in which:

As seen in the figures, the hanger connector of the present invention, generally designated A, is designed to connect a supported hanger, generally designated B, to a supporting hanger, generally designated C. Connector A is preferably formed from a single piece of injection molded plastic.

Figures 1, 2, 3, 4:
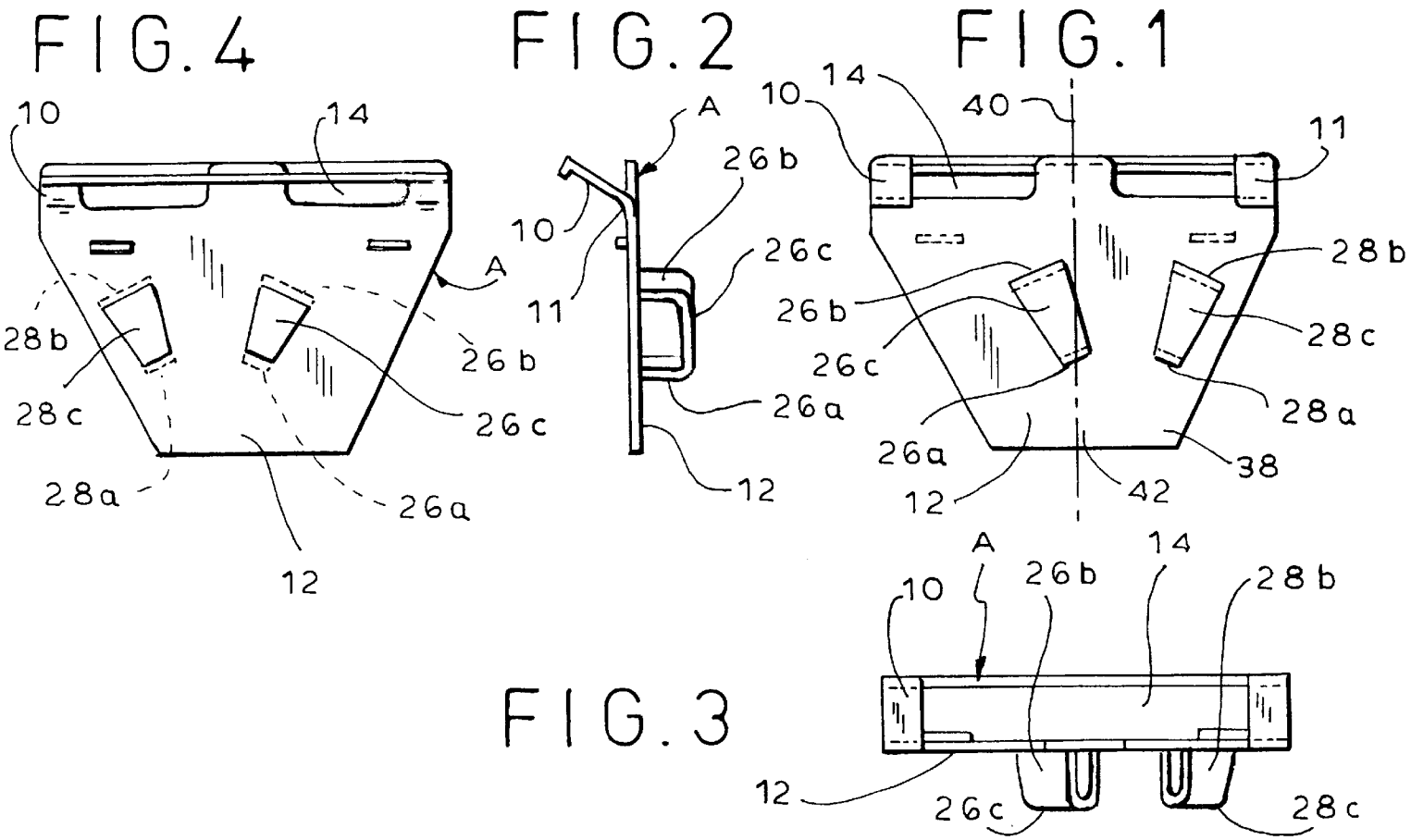
FIG. 1 is a front elevational view of the hanger connector of the present invention.
FIG. 2 is a side elevated view of the hanger connector.
FIG. 3 is a top elevational view of the hanger connector.
FIG. 4 is a rear elevational view of the hanger connector.
Figure 7:
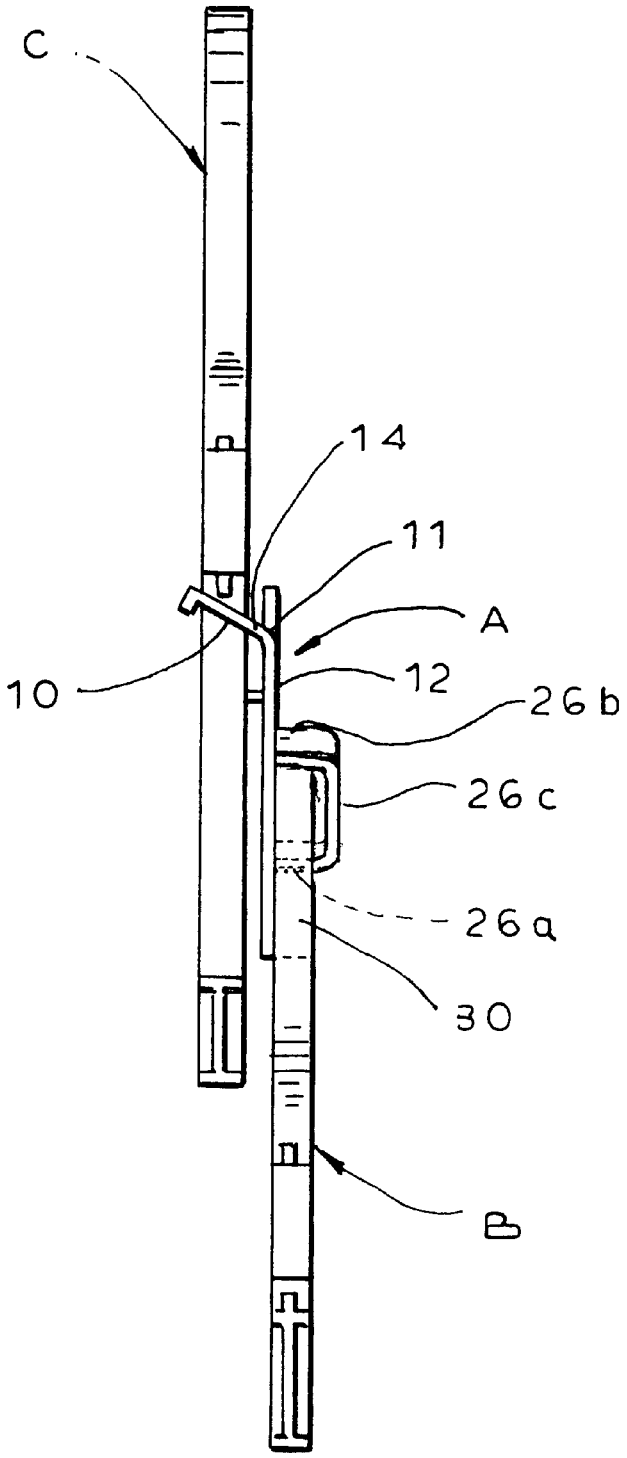
FIG. 7 shows the hangers and connector as seen along line 7—7 of FIG. 6.

As seen in FIGS. 1 through 4, connector A includes first body portion 10 and second body portions 12, joined together in a flexible manner, such as by a "living hinge" 11, as seen in FIG. 2. Body portion 10 is situated in a first plane. Body portion 12 is situated in a second plane. As best seen in FIG. 7, when connector A is mounted on hanger C, these planes form an obtuse angle with each other.

Figure 6:
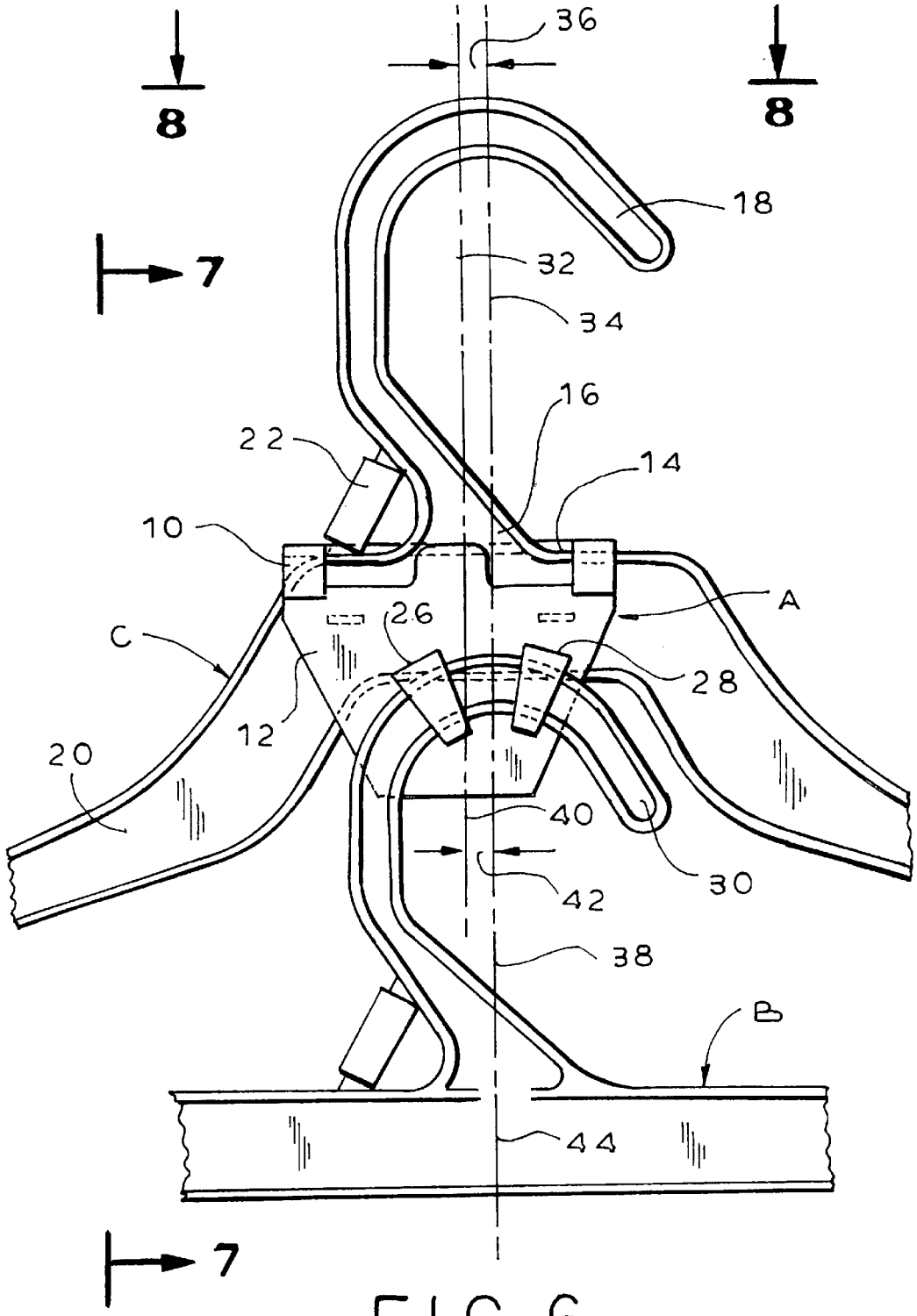
FIG. 6 is a view similar to FIG. 5 but showing the hangers connected by the hanger.

Body portion 10 includes an elongated recess 14. The width of recess 14 is least as wide as the longest portion of the base 16 of the engaging part 18 of the supporting hanger C that joins engaging part 18 and the apparel supporting part 20. Recess 14 is wide enough to insure that body portion 10 of hanger connector A rests on the top edge of the apparel supporting part 20 of the supporting hanger C so as not to obstruct the view of the portion of arcuate part 18 which may carry an indicia bearing removeable clip 22. This is illustrated in FIG. 6. When connector A is in place, body portion 12 is situated in a plane substantially parallel but spaced from the plane of hanger C, as seen in FIG. 7.

Body portion 12 of connector A includes first and second means 26, 28 for engaging the arcuate part 30 of supported hanger B. Each engaging means 26, 28 includes first and second spaced parallel side elements 26*a*, 26*b* and 28*a*, 28*b*, respectively, that extend outwardly from the surface of body portion 12. A bridge element 26*c*, 28*c* connects the side elements so as to define a recess into which the arcuate part 30 of the supported hanger B is adapted to be received. Side elements 26*b*, 28*b* are wider than elements 26*a*, 28*a*, respectively, such that bridge elements 26*c*, 28*c* are tapered to accommodate the different widths of the side elements, as seen in FIGS. 1 and 4.

Figure 8:
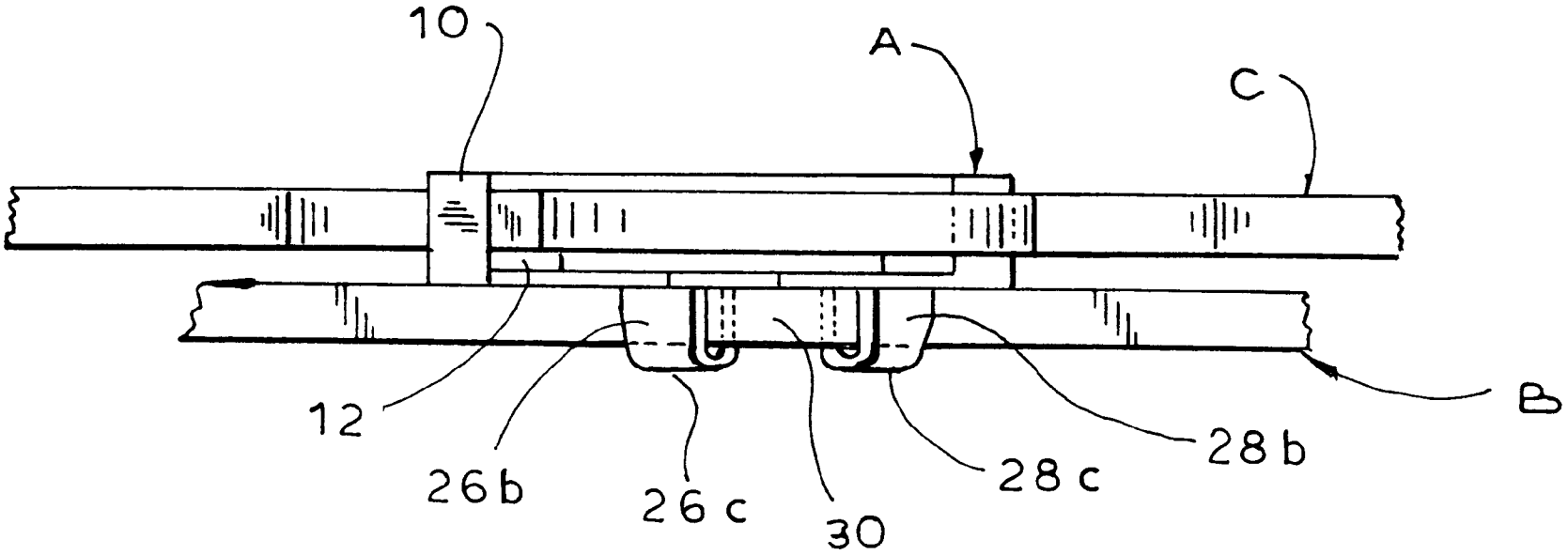
FIG. 8 shows the hangers and connector as seen along line 8—8 of FIG. 6.

Engaging means 26, 28 are located on body portion 12 in spaced relation. They are situated in an arcuate pattern corresponding to the shape of the arc of arcuate part 30 of the supported hanger B. In this manner, when arcuate part 30 of hanger B is retained by engaging means 26, 30, as shown in FIGS. 6, 7 and 8, the supported hanger B is held securely and cannot sway relative to the supporting hanger C.

Figure 5:
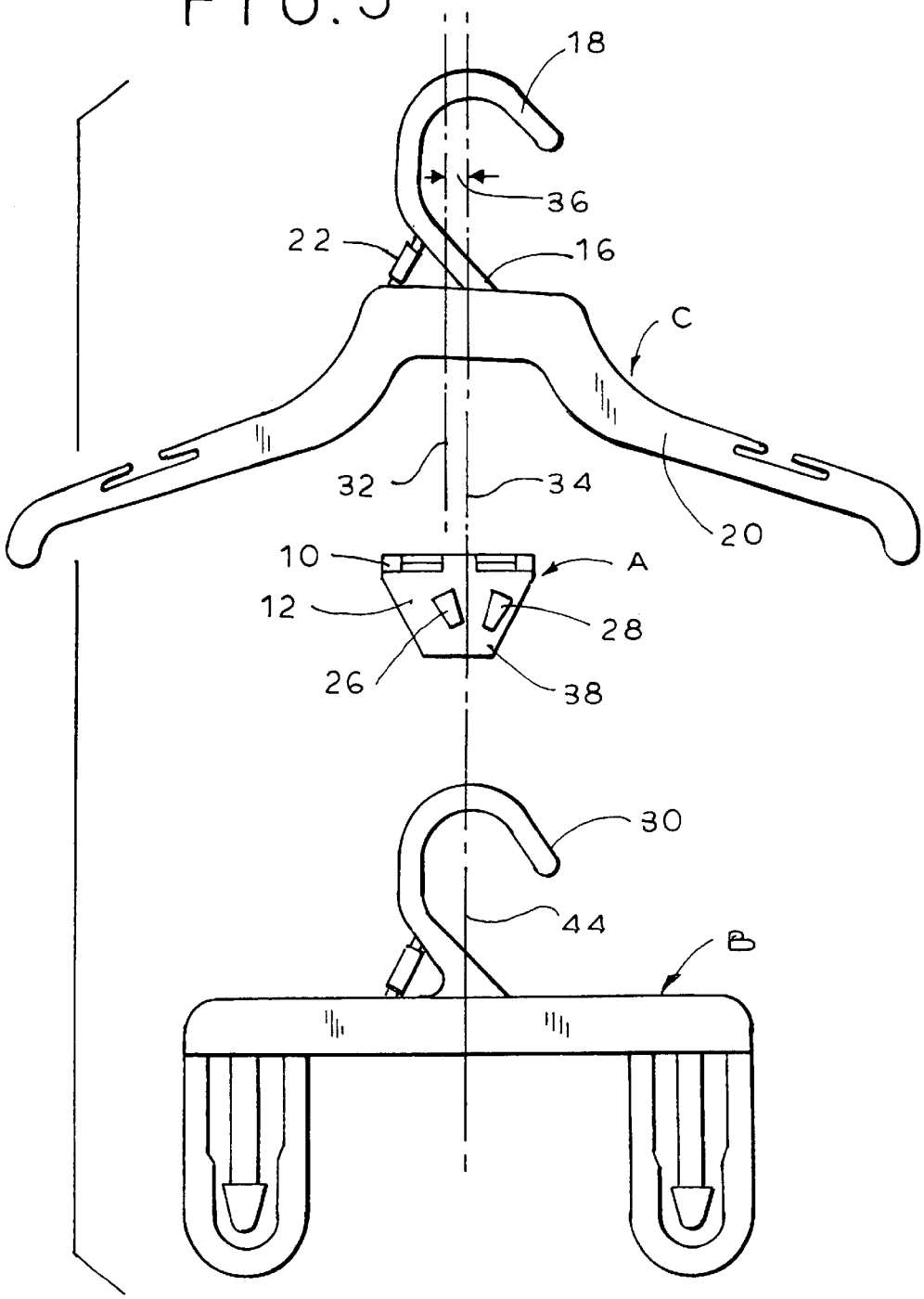
FIG. 5 is an exploded front elevational view of the hanger connector, supporting hanger and supported hanger.

The centerline 32 of engaging part 18 of hanger C is offset from the centerline 34 of hanger C by a distance 36, in a direction towards the left, as seen in FIGS. 5 and 6. Engaging means 26 and 28 on connector A define an arc whose center 38 is offset from the centerline 40 of body portion 12 by a distance 42 in a direction towards the right, as seen in FIGS. 5 and 6. Because distance 36 is equal to distance 42, but extends in the opposite direction, arcuate part 30 of supported hanger B is retained with its centerline 44 aligned with the centerline 34 of the engaging part 18 of supporting hanger B, as seen in FIGS. 5 and 6. Thus, connector A retains the hangers with their centers of gravity situated along the same line preventing the hangers from tipping from the weight of the apparel and the apparel from accidentally falling off the hangers.

It will now be appreciated that the connector of the present invention is a simple structure which can be manufactured inexpensively. It connects the hangers, retaining the supported hanger on the supporting hanger in a manner which prevents relative movement of the hangers, with the weight of both hangers supported along the same centerline.

While only a single embodiment of the present invention has been disclosed for purposes of illustration, it is obvious that many modifications and variations could be made thereto. It is intended to cover all of these modifications and variations which fall within the scope of the invention, as defined by the following claims:

I claim:

1. Apparatus for connecting a first hanger and a second hanger, each of the hangers including an arcuate part for engaging a bar and an apparel supporting part, said apparatus comprising a first body portion defining an opening adapted to receive the arcuate part of the first hanger and a second body portion, and first and second means for engaging the arcuate part of the second hanger, said first and second engaging means being mounted on said second body portion in spaced relation, wherein said first body portion is situated in a first plane and said second body portion is situated in a second plane and wherein said first and said second planes form an obtuse angle.

2. The apparatus of claim 1 wherein said first and second engaging means are located on said second body portion in an arcuate pattern.

3. The apparatus of claim 1 wherein each of said engaging means defines a recess adapted to receive the acurate part of the second hanger.

4. The apparatus of claim 1 wherein each of said engaging means comprises fire and second spaced side elements extending from said second body portion, one of said side elements being wider than the other of said side elements.

5. The apparatus of claim 1 wherein the arcuate part of the first hanger is joined to the apparel supporting part of the first hanger by a base having a given width and wherein said arcuate part receiving opening is at least as wide as said given width.

6. The apparatus of claim 5 wherein an indicia bearing clip is mounted on the engaging part of the first hanger and wherein the clip is not obscured by the connecting apparatus.

7. Apparatus for connecting a first hanger and a second hanger, each of the hangers including an arcuate part for engaging a bar and an apparel supporting part, said apparatus comprising a first body portion defining an opening adapted to receive the arcuate part of the first hanger and a second body portion, and first and second means for engaging the arcuate part of the second hanger, said first and second engaging means being mounted on said second body portion in spaced relation, wherein each of said engaging means comprises first and second spaced side elements extending from said second body portion, one of said side elements being wider than the other of said side elements.

8. The apparatus of claim 7 wherein said first body portion is situated in a first plane and said second body portion is situated in a second plane and wherein said first and said second planes form an obtuse angle.

9. The apparatus of claim 7 wherein each of said engaging means further comprises an element bridging said first and second side elements.

10. The apparatus of claim 9 wherein said bridging element is tapered.

11. The apparatus of claim 7 wherein said first and second side elements are substantially parallel to each other.

12. The apparatus of claim 7 wherein the arcuate part of the first hanger is joined to the apparel supporting part of the first hanger at a point that is offset from the centerline of the first hanger by a given distance, in a given direction.

13. Apparatus for connecting a first hanger and a second hanger, each of the hangers including an arcuate part for engaging a bar and an apparel supporting part, said apparatus comprising a first body portion defining an opening adapted to receive the arcuate part of the first hanger and a second body portion, and first and second means for engaging the arcuate part of the second hanger, said first and second engaging means being mounted on said second body portion in spaced relation, wherein the arcuate part of the first hanger is joined to the apparel supporting part of the first hanger at a point that is offset from the centerline of the first hanger by a given distance, in a given direction.

14. The apparatus of claim 13 wherein said second body portion has a centerline and said engaging means are mounted on said second body portion at positions defining an arc with a center that is offset from said centerline of said second body portion by said given distance, in a direction opposite to said given direction.

15. In combination, a first hanger, a second hanger and means for connecting said first hanger and said second hanger, each of said hangers comprising an arcuate part for engaging a bar and an apparel supporting part, said connecting means comprising a first body portion defining an opening adapted to receive said arcuate part of said first hanger and a second body portion, and first and second means for engaging the arcuate part of said second hanger, said first and second engaging means being mounted on said second body portion in spaced relation, wherein said first body portion is in a first plane and said second body portion is in a second plane and wherein said first and second planes form an obtuse angle.

16. The combination of claim 15 wherein said first and second engaging means are located on said second body portion of said connecting means in an arcuate pattern.

17. The combination of claim 15 wherein each of said engaging means defines a recess adapted to receive said arcuate part of said second hanger.

18. The combination of claim 15 wherein said arcuate part of said first hanger is joined to the apparel supporting part of said first hanger at a point that is offset from the centerline of the said first hanger by a given distance, in a given direction.

19. The combination of claim 15 wherein said arcuate part of said first hanger is joined to said apparel supporting part of the first hanger by a base having a given width and wherein said arcuate part receiving opening is at least as wide as said given width.

20. The combination of claim 19 further comprising an indicia bearing clip mounted on said engaging part of said first hanger, wherein said connecting means is seated on said first hanger so as not to obscure said clip.

21. The combination of claim 15 wherein said first hanger has a centerline and said second hanger has a centerline and wherein said engaging means are situated on said second body portion such that said centerlines of said hangers are substantially aligned.

22. In combination, a first hanger, a second hanger and means for connecting said first hanger and said second hanger, each of said hangers comprising an arcuate part for engaging a bar and an apparel supporting part, said connecting means comprising a first body portion defining an opening adapted to receive said arcuate part of said first hanger and a second body portion, and first and second means for engaging the arcuate part of said second hanger, said first and second engaging means being mounted on said second body portion in spaced relation, wherein each of said engaging means comprises first and second spaced elements extending from said second body portion, wherein one of said side elements is wider than said other of said side elements.

23. The combination of claim 22 wherein said first body portion is in a first plane and said second body portion is in a second plane and wherein said first and second planes form an obtuse angle.

24. The combination of claim 22 wherein each of said engaging means comprises first and second spaced elements extending from said second body portion, wherein one of said side elements is wider than said other of said side elements.

25. The combination of claim 22 wherein each of said engaging means further comprises an element bridging said first and second side elements.

26. The combination of claim 25 wherein said bridging element is tapered.

27. The combination of claim 22 wherein said first and second side elements are substantially parallel to each other.

28. In combination, a first hanger, a second hanger and means for connecting said first hanger and said second hanger, each of said hangers comprising an arcutate part for engaging a bar and an apparel supporting part, said connecting means comprising a first body portion defining an opening adapted to recieve said arcuate part of said first hanger and a second body portion, and first and second means for engaging the arcuate part of said second hanger, said first and second engaging means being mounted on said second body portion in spaced relation, wherein said arcuate part of said first hanger is joined to the apparel supporting part of said first hanger at a point that is offset from the centerline of the said first hanger by a given distance, in a given direction.

29. The combination of claim 28 wherein said second body portion has a centerline and said engaging means are mounted on said second body portion at positions defining an arc with a center that is offset from said centerline of said second body portion by said given distance, in a direction opposite to said given direction.

* * * * *